United States Patent [19]

Stevens

[11] 4,013,290

[45] Mar. 22, 1977

[54] RACKET FOR TENNIS AND SIMILAR GAMES

[76] Inventor: Robert Stevens, 552 Glorietta Ave., Newport Beach, Calif. 92660

[22] Filed: Mar. 26, 1973

[21] Appl. No.: 344,751

Related U.S. Application Data

[63] Continuation-in-part of Ser. No. 252,044, May 10, 1972, abandoned.

[52] U.S. Cl. ..... 273/73 E

[51] Int. Cl.[2] ..... A63B 51/12

[58] Field of Search ..... 273/73 R, 73 C, 73 D, 273/73 E, 73 G, 73 H, 73 J, 73 L

[56] References Cited

UNITED STATES PATENTS

| | | | |
|---|---|---|---|
| 240,183 | 4/1881 | Richardson | 273/73 E |
| 1,912,942 | 6/1933 | Kleinman | 273/73 E |
| 2,542,661 | 2/1951 | Godfrey | 273/73 D |

FOREIGN PATENTS OR APPLICATIONS

| | | | |
|---|---|---|---|
| 798,744 | 11/1968 | Canada | 273/73 H |
| 234,021 | 5/1925 | United Kingdom | 273/73 E |
| 291,141 | 5/1928 | United Kingdom | 273/73 E |
| 359,227 | 10/1931 | United Kingdom | 273/73 E |
| 395,032 | 7/1933 | United Kingdom | 273/73 E |
| 224,724 | 11/1924 | United Kingdom | 273/73 H |
| 2,647 | 6/1880 | United Kingdom | 273/73 E |
| 5,025 | 3/1915 | United Kingdom | 273/73 E |

*Primary Examiner*—Richard J. Apley
*Attorney, Agent, or Firm*—Keith D. Beecher

[57] ABSTRACT

An improved racket is provided, for tennis and similar games, which incorporates a means for adjusting the string tension so that a proper tension may be maintained at all times when the racket is in use, and so that the tension of the strings of the racket may be relieved when the racket is not in use. The racket includes a resilient frame with an elongated handle attached to one end. The frame has a looped head portion with holes extending around its periphery to accommodate the strings. One string is mounted on the frame in a series of lateral passes extending across the area circumscribed by the head portion of the frame, a second string is mounted on the frame in a series of passes which extend vertically across the circumscribed area. Two plastic-encased metal arms are mounted to extend partially around both lower sides of the head portion of the frame. Appropriate grooves are formed in the plastic casing of the arms, and the lower ends of the vertical passes are looped around these arms. The ends of the arms are attached to an adjusting means which serves to pull the vertical passes into tension, thereby producing a compressive load on the frame of the racket. The frame then extends its lateral dimension to redistribute the load and produce equalizing tension on the lateral passes.

8 Claims, 13 Drawing Figures

18
30
18
12
10
12
24
24
24
12
14
24
12
Slot-39
24
38
Slot-39
32
40
13
40
46
44
42
Key

RACKET FOR TENNIS AND SIMILAR GAMES

This application is a continuation-in-part of copending application Ser. No. 252,044 which was filed May 10, 1972 in the name of Robert Stevens and now abandoned.

BACKGROUND OF THE INVENTION

Designs for tennis rackets have been provided in the past which incorporate tension-controlling means for the strings of the racket, so that the tension of the strings may be adjusted to maintain a certain degree of string tension during the operation of the racket. However, the prior racket designs have proven to be relatively ineffective. This is primarily due to the fact that difficulties have been evident in providing appropriate means in conjunction with the prior art racket which would be effective for properly controlling the string tension.

It is important that the string-tensioning means be relatively simple in its aspect so that it does not interfere in any way with the normal use of the racket. Also, the string-tensioning means must be simple to adjust, and it must operate to provide a desired tension to both the vertical and lateral passes of the racket strings with an equal distribution of tautness over the entire face of the racket. It is also important that the adjustment means be easy to operate and positive in its action.

The racket of the present invention incorporates a string-tensioning means which fulfills all the foregoing criteria, and which operates with a high degree of satisfaction in controlling the string tension of the racket to any degree of tautness. The string-tensioning mechanism of the invention in no way interferes with the normal operation of the racket, and it may be relatively light, so as not to add in any material way to the weight of the racket. Also, the mechanism of the invention, as will be described, is smooth and easy to operate.

DETAILED DESCRIPTION OF THE ILLUSTRATED EMBODIMENTS

Figure 1:
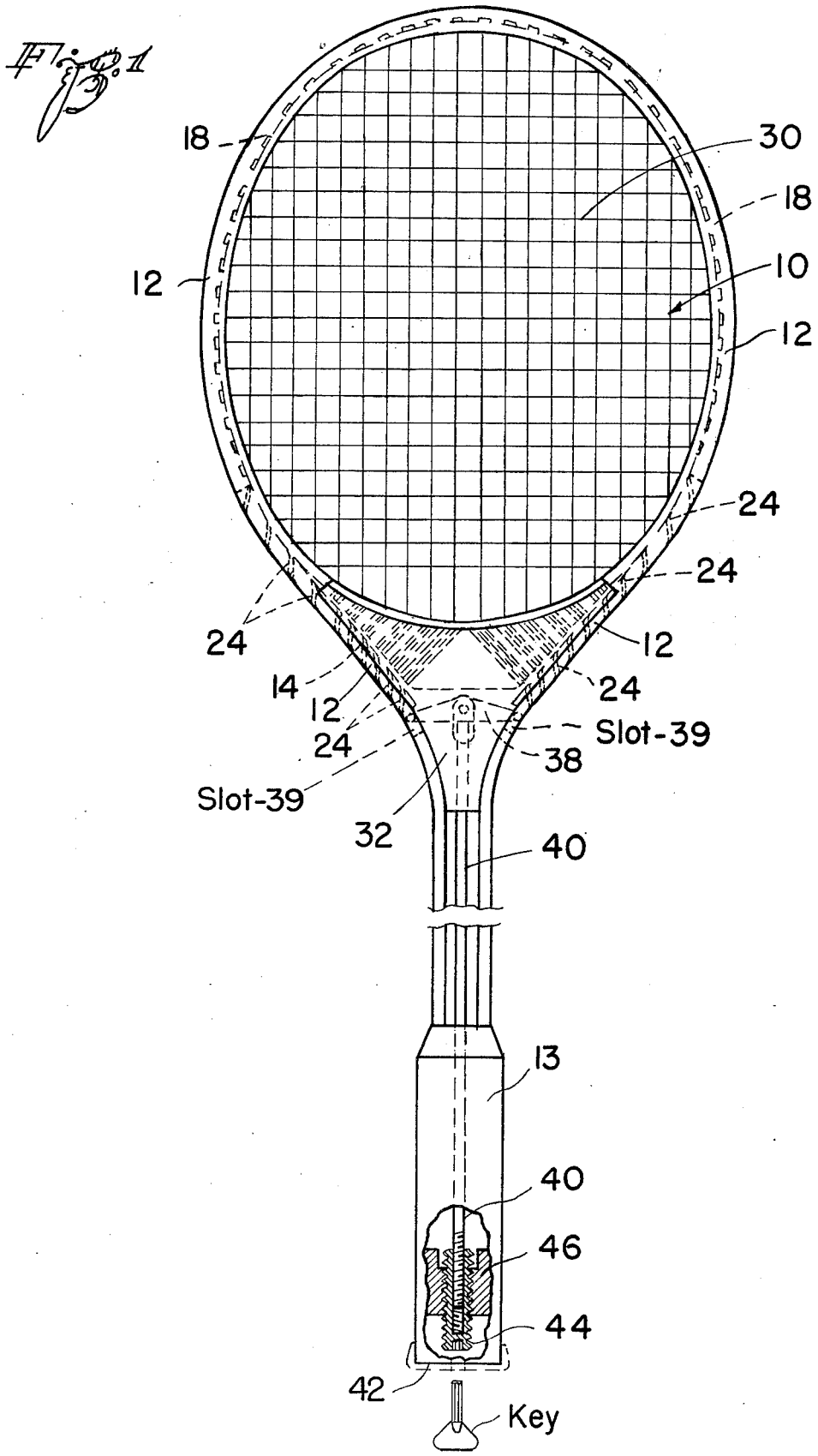
FIG. 1 is a plan view of a tennis racket which may be constructed to incorporate the concepts of the invention.

The racket designated 10 in FIG. 1 incorporates the adjustable string-tension control mechanism of the present invention. Yet, it conforms in all respects with conventional tennis rackets with regard to size, weight and dimensions. The purpose of the invention is to provide a tennis racket in which the string tension may be easily adjusted to the most efficient tautness, thereby eliminating the need for constant restringing of the racket; and one in which the string tension may be relieved when the racket is not in use.

The illustrated embodiment of the racket 10 may have a frame of tubular metal or solid metal extrusion, which permits conventional stringing of the racket. Specifically, the racket 10 may include a metal tubular or extruded frame member 12 which has a looped head portion with an outer portion and a continuous inner portion bent into the desired annular shape. The outer portion is configured to define an outer groove or channel about the perimeter of the head portion. The ends of the outer portion of the frame extend down from the lower end of the head portion in spaced parallel relation. An elongated handle 13 is attached to the parallel ends of the frame as is usual in the construction of tennis rackets. The frame 12 may be formed, for example, of a single extrusion, or of multiple extrusions.

A pair of metal arms 16, each encased in a plastic casing 14, (FIGS. 1 and 7) are slidably received in the outer channel of the lower end of the head portion of the frame, and these arms extend from the neck portion of the racket partially around the outer periphery of the head portion of frame 12, as shown in FIG. 1. The plastic-encased arms 16 are mounted on opposite sides of the frame.

Figure 2A:
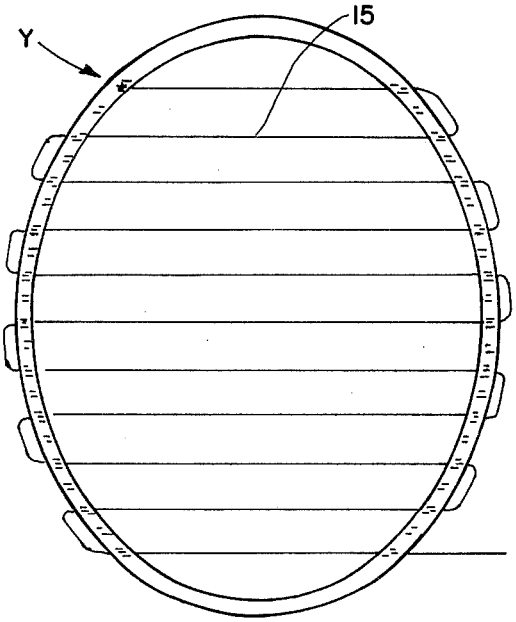
FIGS. 2A – 2C are views of the head of the racket, showing the manner in which it is strung.
Figure 2B:
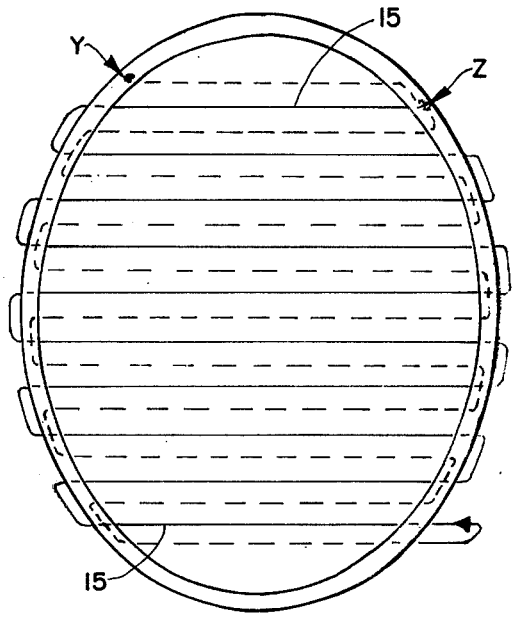
Figure 2C:
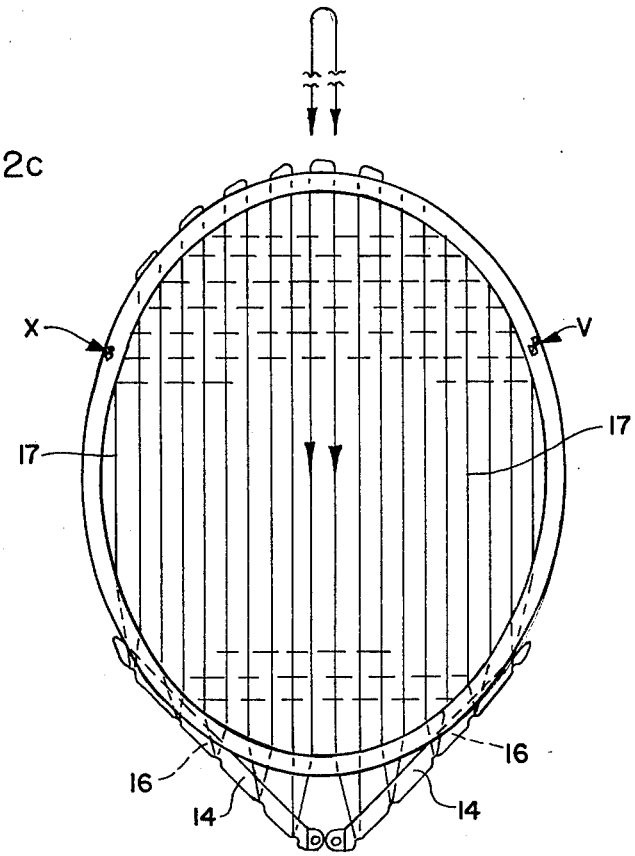

The strings of the racket are strung in a series of vertical and lateral passes, as shown in FIGS. 2A–2C, and they extend through holes in the head portion of the frame and are generally looped around the frame between the holes in a manner well understood in the art. For example, a first string 15 is knotted at *y* (FIG. 2A) and is strung in the head portion in a series of lateral passes, as shown. This string is then continued, as shown in FIG. 2B, to complete the lateral passes, and is knotted at its other end at *z*. A second string 17 is knotted at *x* (FIG. 2C) and is strung in the head of the racket in a series of vertical passes, and its other end is knotted at *v*. The vertical passes at the lower end of the head portion of the frame are looped around the plastic casings 14 and serve to hold the casings and arms 16 in place as shown in FIG. 2C.

Figure 7:
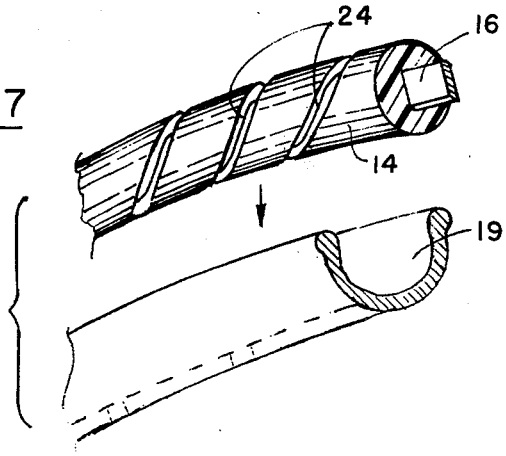
FIG. 7 is a fragmentary exploded representation of one of a pair of plastic-encased arms used in the racket, and showing the manner in which the arm is slidably received in an external channel extending around the frame of the racket.
Figure 6:
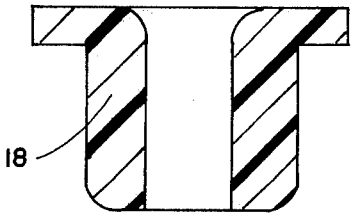
FIG. 6 is an enlarged sectional representation of one of a multiplicity of plastic grommets which are inserted into the holes in the frame of the racket.
Figures 8, 9:
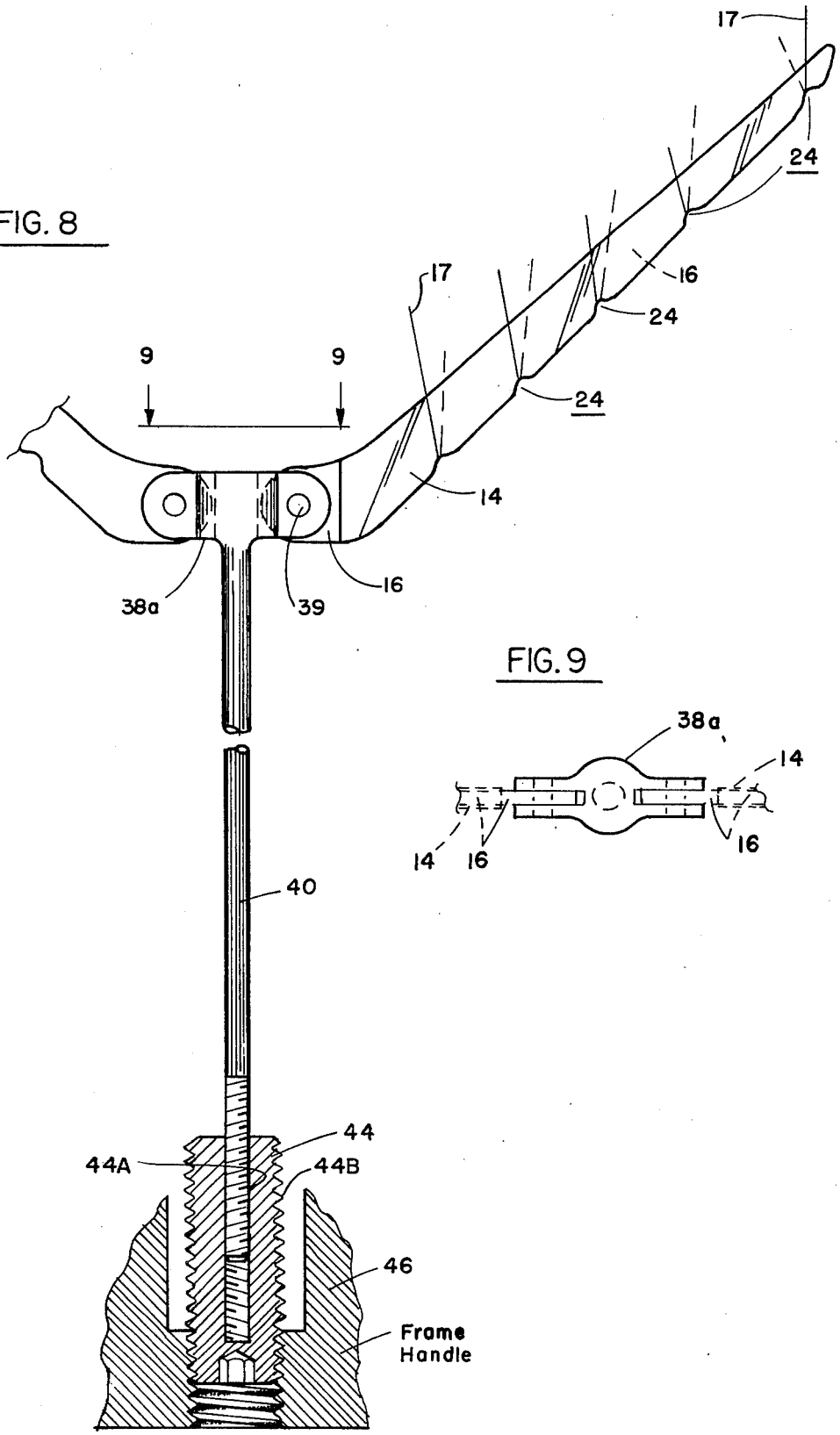
FIG. 8 is a fragmentary representation of a second embodiment of the invention.
FIG. 9 is an end view of a clevis used in the embodiment of FIG. 8, and taken substantially along the line 9—9 of FIG. 8.

Each arm 16 and its plastic casing 14 may ride on plastic inserts such as grommets 18 of FIG. 6, which, in turn, are mounted in the holes of the frame 12. The inserts may alternatively each be a single elongated member 19 (FIG. 7) fitted within the peripheral groove of the head of frame 12; the inserts 18, or the elongated member 17, may be formed, for example, of an appropriate plastic material such as nylon. The inserts 18, or the elongated member 17, provide a low friction base for the plastic-encased arms 16. The plastic casings 14 of the arms 16 each has grooves 24 formed in it, as best shown in FIG. 7 and FIG. 8, and the vertical passes at the handle end of the head portion of the frame are looped around the grooves as shown in FIG. 2C.

The mechanism described above recognizes that the elongation of each pass of the racket strings is proportional to the length of the string in the presence of a particular tension force. Thus, the two arms 16, when they are moved cause an increasing displacement of the vertical passes towards the center line of the racket. That is, the center vertical pass is pulled a maximum distance for each displacement of the arms 16 and the other passes on each side of the vertical pass are pulled progressively through lesser distances.

As the vertical passes are pulled the resulting deformation of the resilient frame 12 causes it to increase its lateral dimensions. Again, this latter increase is greatest at the central and longest lateral pass, and is progressively less for the lateral passes on each side of the central pass.

Thus, as the mechanism is adjusted to tighten the strings all of the strings are properly tensioned for a uniform tautness over the entire racket face.

Figure 4:
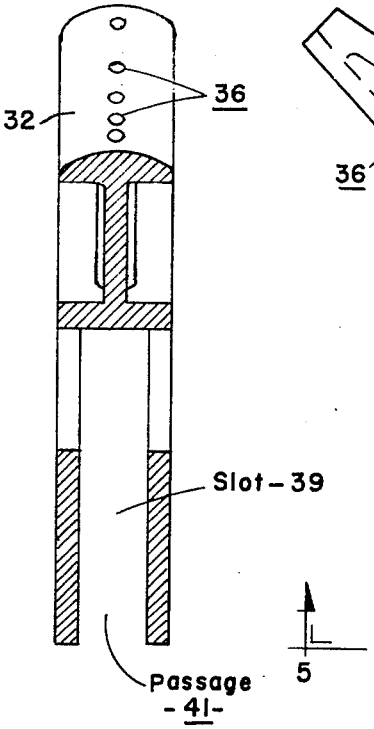
FIGS. 3, 4 and 5 are various views of an insert which may be incorporated into the neck of the racket, in one of its embodiments, for reasons to be described.
Figure 3:
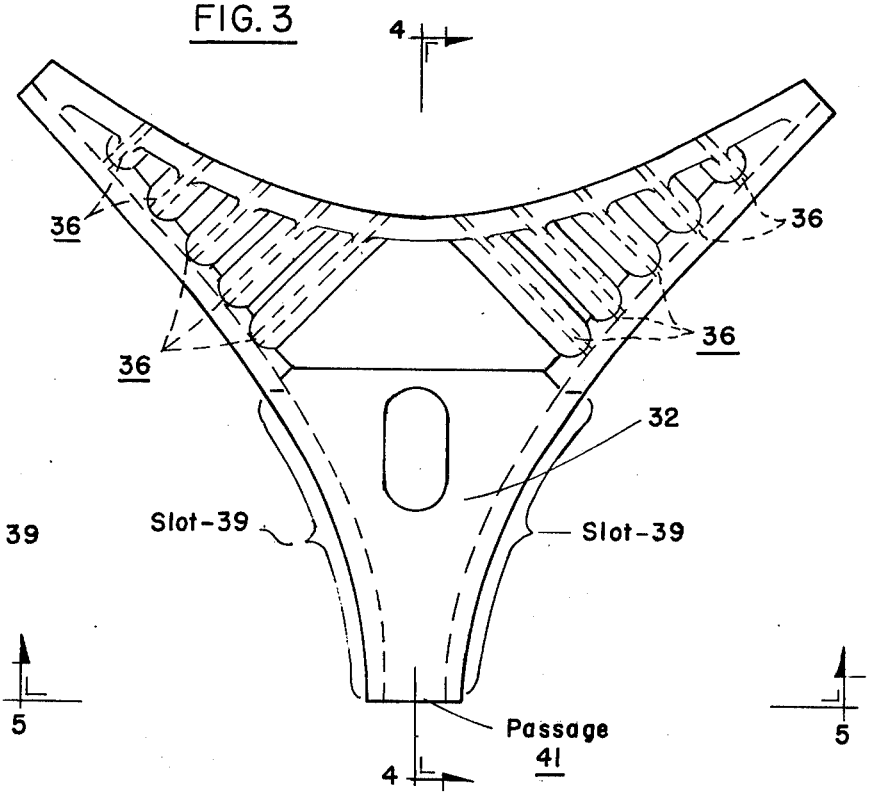
Figure 5:
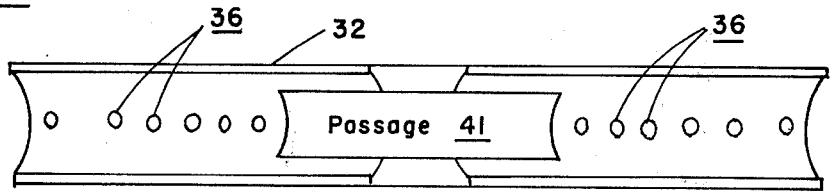

A fitting 32, as best shown in FIGS. 3, 4 and 5, is mounted in the neck of the racket of FIG. 1. The fitting 32 may be formed of plastic or any other suitable material. The fitting defines a series of passages 36 on either side which permit the lower ends of the vertical passes of the string 17 to be directed along the appropriate paths to be looped around the respective grooves 24 in the plastic casings 14 of the arms 16, as shown in FIG. 1. The lateral passes of the string 15 extend through the holes in the head of the frame and through the inserts 18, and are looped around the frame between the holes in the usual manner. These lateral passes are not looped around the casings 14 and are not directly controlled by movement of the arms 16.

The lower ends of the arms 16 in FIG. 1 are attached by appropriate pins or other fasteners to a transverse yoke 38 which is mounted in the fitting 32, and whose arms extend out through slots 39 in the sides of the fitting as shown in FIG. 1. The yoke 38 is connected to a rod 40 through a passage 41 (FIG. 3) in the fitting to extend down the length of the handle 13 to an adjusting mechanism (FIG. 1) at the base of the handle.

The adjusting mechanism is normally covered by a cap 42 fitted over the end of the handle, or by a handle covering without a separate cap. The cap may be removed to reveal a plug 44 which is threaded into a socket 46, and which is also threaded to the end of the rod 40. Adjustment of the plug 44 in one angular direction causes the yoke 38 to be pulled down into the handle 13, since the pull rod 40 is prevented from turning with the resulting movement of the arms 16 to tighten the vertical string 17. Reverse angular adjustment of the plug slackens the strings. The number of threads per inch of the internal and external threads of the plug 44 are made different to yield a mechanical advantage when the plug is turned. This is most important in that it provides for the production of the high tension forces required to tighten the racket strings without the concomitant requirements of a high manual adjustment torque.

The insert 32 of the embodiment of FIG. 1, assures that the lower end of the central vertical strings 30 will be properly directed to the corresponding grooves 24 in the plastic casing 14 of the arms 16, so that a smooth and easy tensioning of the vertical passes of string 17 may be achieved. The tensioning of the vertical passes places a compressive load on the resilient frame 12, causing it to redistribute the load by lengthening the lateral axis of the frame, thus causing corresponding tensioning of the lateral passes of string 15.

Therefore, by means of the mechanism and assembly described above, a uniform tensioning of the strings 15, 17 may be achieved by a simple tensioning of the vertical string only, and by relying on the resilience of the frame to redistribute the resulting compressive load thereof and achieve a corresponding tensioning of the lateral string.

Figure 10:
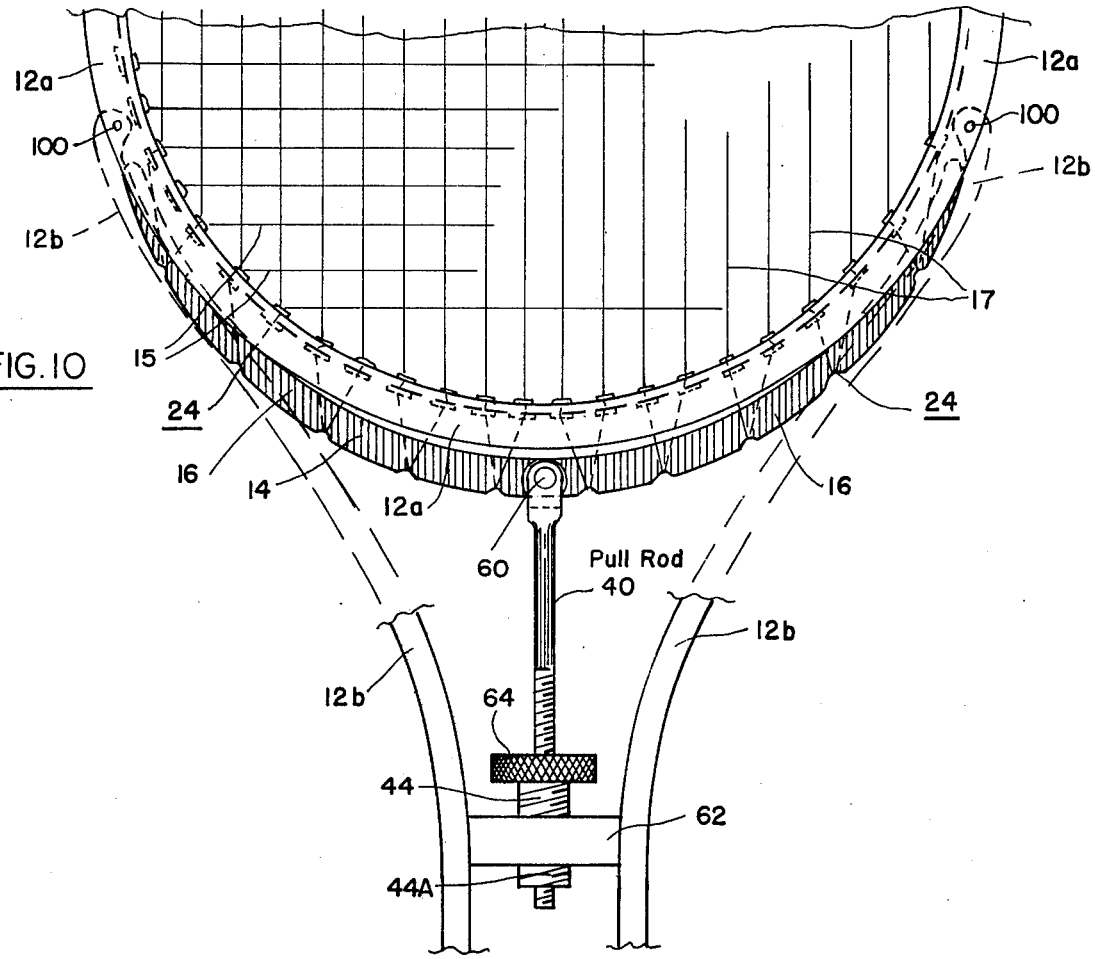
FIG. 10 is a fragmentary representation of yet another embodiment of the invention.

The embodiment of FIG. 8 is generally similar to that of FIG. 1, except that no plastic insert 32 is used, in that the head of the frame in this embodiment is made of a simple extension formed into a continuous loop joined at the handle end, as shown in FIG. 10, and the yoke 38 is replaced by a somewhat more simple clevis **38*a*. The clevis 38*a* is integral with the upper end of the pull rod 40, and it is pivotally attached to the ends of the arms 16 by appropriate pins, such as the pin 39. As in the previous embodiment, the arms 16 may be formed of steel, for example, and covered with a bonded plastic coating 14 to provide a low friction contact surface with the outer periphery channel of the looped head portion of the frame 12, and with the heads of the adjacent grommets 18; and the lower ends of the vertical string 17 are looped through the notches 24 on the plastic coating 14**.

The screw mechanism of the embodiment of FIG. 8 may be similar to that shown in FIG. 1 and described above. As before, a hexagonal socket, or the like, may be provided in the lower end of the plug 44 to receive an adjustment key, or an external knob may be provided on the lower end of the plug. It might be noted that by an appropriate selection of the sizes of the internal threads 44A and threads 44B external for the plug 44, a mechanical advantage of the order of 375:1 may be obtained.

In the embodiment of FIG. 10, the separate clevis **38*a* of FIG. 8 is eliminated, and the ends of the arms 16 are pivoted together through a common pivot pin 60 which also extends through the end of the pull rod 40. The head portion 12*a* of the frame in FIG. 10 is formed as a complete loop, and the neck portion is formed, either by separate members 12*b*, or by the bifurcated ends of a single extruded shaft and which form the members 12*b*. The members 12*b* may be attached to the head portion of the frame by welding or other appropriate means. For example, the members 12*b* may be rivetted to the head portion by rivets 100. The embodiment of FIG. 10, like the embodiment of FIG. 8 does not incorporate the plastic insert 32 of the embodiment of FIG. 1**.

Figure 11:
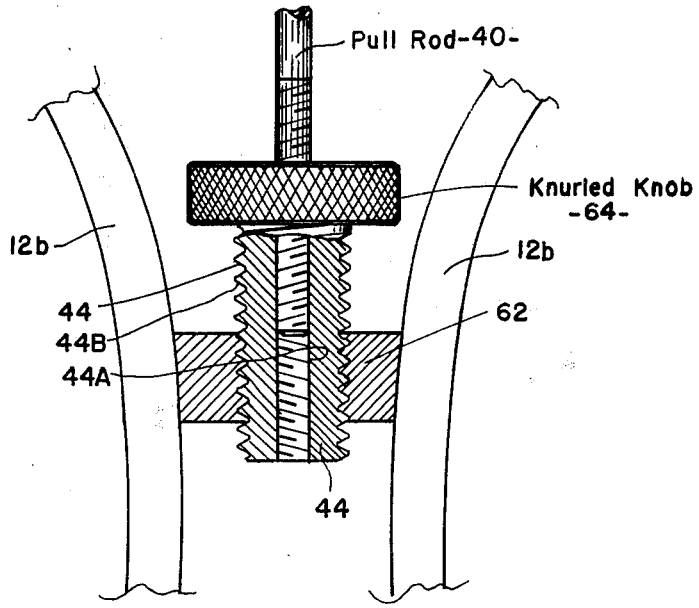
FIG. 11 is a fragmentary section of an adjusting mechanism which may be used in conjunction with the embodiment of FIG. 10.

A somewhat different screw adjusting mechanism is used in the embodiment of FIG. 10 which may be mounted either in the open neck portion of the racket, as shown, or at the lower end of FIG. 10, and as best shown in FIG. 11, a brace 62 is mounted in the neck portion which has a central threaded hole for receiving the plug 44. The plug 44, as in the previous embodiment has external threads which engage the threads in the brace 62, and it also has internal threads which receive the threaded lower end of the pull rod 40.

By making the internal threads 44A and external threads 44B of the plug 44 of different sizes, a mechanical advantage may be achieved, as described above. In the latter embodiment, and as shown in FIGS. 10 and 11, a knurled knob 64 is affixed to the upper end of the plug 44, and appropriate adjustment is made by manually turning the knurled knob.

By use of the technique illustrated by the embodiments described above, the adjusting mechanism may be relatively light and simple, since it is coupled only to the lower ends of only the vertical strings of the racket, and no attempt is made to couple the adjusting mechanism to both the vertical and lateral strings, as is the common practice in the prior art. Such a prior art arrangement produced excessive friction problems, and required heavy and complex adjusting mechanisms and still did not assure equal tensioning of all the strings of the racket. Such prior art rackets also failed to take into account the fact that different passes of the strings of the racket of different lengths must travel different distances to assure uniform tautness.

The concept of the present invention, as revealed by the structural combinations described above, is one in which the vertical strings are moved distances proportional to their lengths to assure uniform tensioning, and the resulting load created by the tensioning of the vertical strings in such a proportional manner, as described above, is redistributed, also in a proportional manner to the horizontal strings by the resilience and resulting lateral distortion of the racket frame. This redistribution takes place as the lateral dimension of the frame increases, thus assuring an equal distribution of string tautness over the entire face of the racket.

The invention provides, therefore, an improved tennis racket which is constructed so that its strings may be set to any desired degree of tautness, and which eliminates the need for frequent re-stringing of the racket. The particular mechanism of the invention, as evidenced by the embodiments described above, constitute a simple means for enabling all the strings of the racket to be simultaneously tightened or loosened, without any excessive frictional forces being created with respect to any of the strings. This means that there is no need for the adjusting mechanism to exert excessive forces. The mechanism of the invention is constructed so that both the vertical and horizontal strings of the racket are tightened with essentially equal tension when the mechanism is adjusted.

It will be appreciated that although particular embodiments of the invention have been shown and described, modifications may be made. It is intended in the following claims to cover all modifications which come within the spirit and scope of the invention.

What is claimed is:

1. A game racket including: an annular head portion composed of a resilient material; a first string for the racket looped through holes in the head portions in a first series of passes extending transversely across the area circumscribed by the head portion, and a second string for the racket looped through holes in the head portion in a second series of passes extending longitudinally across the area circumscribed by the head portion; an elongated handle affixed to the head portion; a neck portion interposed between the handle and the head portion; first and second arms each extending partially around the opposite sides of said head portion on the outer peripheral surface thereof a limited distance adjacent said neck portion, said arms being coupled to the adjacent ends of said second series of passes; and an adjusting means attached to said arms to produce sliding movement of said arms relative to said head portion along the outer peripheral surface thereof to pull said second series of passes into tension by differential amounts proportional to the individual lengths of the passes of said second series, thereby to compress said head portion and cause said head portion to extend its lateral dimensions, thereby to pull said passes of said first series into tension by differential amounts proportional to the individual lengths of said passes of said first series, so as to distribute the load applied thereto and thereby to pull the first series of passes into tension corresponding to the tension of the second series of passes.

2. The racket defined in claim 1, in which each of said arms is encased in a plastic casing having grooves therein for receiving the ends of said passes of said second series.

3. The racket defined in claim 1, in which said elongated handle is generally hollow, and in which said adjusting means is mounted in said handle adjacent the remote end thereof.

4. The racket defined in claim 1, in which said adjusting means is mounted in said neck portion between said head portion and the adjacent end of said elongated handle.

5. The racket defined in claim 1, and which includes pivot means interconnecting said arms within said neck portion, a pull rod connected at one end to said pivot means, a plug threaded to the remote end of said pull rod by a first series of threads, a socket mounted on said racket in coaxial relationship with said plug and said rod, said socket threadably receiving said plug by a second series of threads, in which the numbers of threads per inch of the first and second series are different to create a mechanical advantage to the adjusting means.

6. The racket defined in claim 5, in which said plug and socket are mounted in said neck portion.

7. A game racket including: an annular head portion composed of a resilient material; a first string for the racket looped through holes in the head portion in a first series of passes extending transversely across the area circumscribed by the head portion, and a second string for the racket looped through holes in the head portion in a second series of passes extending longitudinally across the area circumscribed by the head portion; an elongated handle affixed to the head portion; a neck portion interposed between the handle and the head portion; first and second arms each extending partially around the opposite sides of said head portion a limited distance adjacent said neck portion, said arms being coupled to the adjacent ends of said second series of passes; and adjusting means attached to said arms to produce sliding movement of said arms relative to said head portion along the peripheral surface thereof to pull said second series of passes into tension by differential amounts proportional to the individual lengths of the passes of said second series, thereby to compress said head portion and cause said head portion to extend its lateral dimensions, thereby to pull said passes of said first series into tension by differential amounts proportional to the individual lengths of said passes of said first series, so as to distribute the load applied thereto and thereby to pull the first series of passes into tension corresponding to the tension of the second series of passes, and a pull rod connected to said arms, a plug threaded to the remote end of said pull rod by a first series of threads, a socket mounted on said racket in coaxial relationship with said plug and said rod, said socket threadably receiving said plug by a second series of threads, and in which the numbers of threads per inch are of the first and second series are different to create a mechanical advantage to the adjusting means.

8. A game racket including: an annular head portion composed of a resilient material; a first string for the racket looped through holes in the head portion in a first series of passes extending across the area circumscribed by the head portion, and a second string for the racket looped through holes in the head portion in a second series of passes extending transversely of the first series across the area circumscribed by the head portion; an elongated handle affixed to the head portion; adjusting means attached to the passes of the second series for tensioning the strings; a pull rod connected to said adjusting means and extending coaxially with said handle; a rotatable plug threaded to the remote end of said pull rod by a first series of threads; and a socket threadably receiving said rotatable plug by a second series of threads, in which the numbers of threads per inch of the first and second series are different to create a mechanical advantage to the adjusting means.

* * * * *